US007354011B2

(12) United States Patent
Virving

(10) Patent No.: US 7,354,011 B2
(45) Date of Patent: Apr. 8, 2008

(54) REFINING ELEMENT

(75) Inventor: Nils Virving, Hässelby (SE)

(73) Assignee: Metso Paper, Inc. (FI)

( * ) Notice: Subject to any disclaimer, the term of this patent is extended or adjusted under 35 U.S.C. 154(b) by 0 days.

(21) Appl. No.: 10/486,413

(22) PCT Filed: Jul. 31, 2002

(86) PCT No.: PCT/SE02/01421

§ 371 (c)(1),
(2), (4) Date: Feb. 9, 2004

(87) PCT Pub. No.: WO03/015924

PCT Pub. Date: Feb. 27, 2003

(65) Prior Publication Data

US 2004/0173702 A1 Sep. 9, 2004

(30) Foreign Application Priority Data

Aug. 15, 2001 (SE) ..... 0102726

(51) Int. Cl.
*B02C 7/04* (2006.01)
*B02C 7/06* (2006.01)
*B02C 13/20* (2006.01)

(52) U.S. Cl. ..... 241/261.2

(58) Field of Classification Search ..... 241/260, 241/261.2, 261.3
See application file for complete search history.

(56) References Cited

U.S. PATENT DOCUMENTS 2,035,994 A * 3/1936 Sutherland, Jr. ..... 241/21
5,042,726 A * 8/1991 Reinhall ..... 241/28

FOREIGN PATENT DOCUMENTS

SE 510 948 A1 5/1999
WO WO 99/26725 * 6/1999

* cited by examiner

*Primary Examiner*—Bena Miller
(74) *Attorney, Agent, or Firm*—Lerner, David, Littenberg, Krumholz & Mentlik, LLP

(57) ABSTRACT

A refiner system is disclosed including a first refiner element and a second refiner element adapted for mounting a refiner for relative rotation with a refining gap between them for processing lignocellulosic material, each of the first and second refiner elements including a refining surface, pins extending upwardly from the refining surfaces whereby the pins on the first refiner surface are disposed in intermediate spaces between the pins on the second refiner surface, each of the first and second refining surfaces further including bars including rounded edges forming a wave-shaped surface thereon.

6 Claims, 1 Drawing Sheet

REFINING ELEMENT

FIELD OF THE INVENTION

The present invention relates to refining elements for use in refiners of the disc-type for processing, such as defibering, refining or disperging, lignocellulosic fibrous material in the form of chips or pulp. The object of such processing can be the manufacture of, for example, recycled fiber pulp or mechanical pulp, such as thermo-mechanical pulp (TMP) and chemi-thermo-mechanical pulp (CTMP). More particularly the present invention relates to a pair of co-acting refining elements intended to be placed directly in front of each other on opposed refining discs in a refiner of the above type.

BACKGROUND OF THE INVENTION

The processing of fibrous material takes place in a refining gap which is formed between the refining elements on two opposed refining discs rotating relative to one another. The fibrous material is thus subjected to mechanical action by processing means on the refining elements, and at the same time the material moves outwardly by the action of centrifugal force. The processing means can be formed as continuous or discontinuous bars, teeth or in some other way.

During the defibering of fibrous material in the form of chips the chip bits are intended to be disintegrated to individual fibers with the least possible shortening of the fibers. Tests have shown that the design of the refining elements in the inner portion of the refining gap is of great importance for the feeding of the material through the refining gap as well as for the overall defibering process. During the disperging of recycled fiber pulp it is desired to obtain a processing which does not cause any shortening of the fibers or lowering of the freeness value (CS, F) of the pulp.

The processing which causes fibrillation and fiber shortening mostly takes place when the refining means are formed as bars by action of the edges of the bars.

Conventional refining elements with processing means in the form of bars with intermediate grooves can also give rise to a non-uniform material flow through the refining gap. This implies at the same time that the load on the motor or motors driving one or both of the refining discs will be uneven. As a result, the process is difficult to control, and the energy consumption increases. It also can affect the quality of the processed pulp.

It is also known to form the refining elements with processing means in the form of projecting pins, where the pins from one refining element extend into the intermediate space between the pins on the opposed refining element. This type of refining elements is shown, for example, in Swedish patent specification No. 510,948. With these refining elements a lenient defibering process is obtained, which does not cause any fiber shortening. There is risk, however, of an insufficient defibering effect.

SUMMARY OF THE INVENTION

In accordance with the present invention, these processes have been improved upon by the discovery of a refiner system including a first refiner element and a second refiner element, the first and second refiner elements adapted for mounting in a refiner for relative rotation in a face-to-face relationship with a predetermined gap therebetween for processing lignocellulosic material within the predetermined gap, each of the first and second refiner elements including a refining surface, a plurality of pins extending upwardly from the refining surfaces whereby the plurality of pins on the first refining surface are disposed in intermediate spaces between the plurality of pins on the second refining surface, each of the first and second refining surfaces further including a plurality of bars including rounded edges forming a wave-shaped surface thereon. Preferably, the plurality of pins on the first and second refining surfaces include rounded upper surfaces.

In accordance with one embodiment of the refiner system of the present invention, the plurality of bars on the first and second refining surfaces extend substantially radially across the refining surfaces.

In accordance with another embodiment of the refiner system of the present invention, the first and second refining surfaces include a plurality of ledges formed as circular arches on the refining surfaces relative to the plurality of pins.

In accordance with the present invention, a solution to the aforesaid problems is offered. Opposed co-acting refining elements are provided with projecting processing means in the form of pins, which extend upwardly from the bottom surface of the refining elements, where the pins on one refining element are arranged to extend into the intermediate spaces between the pins on the opposed co-acting refining element. The bottom surface of each of the refining elements between the pins are wave-shaped to co-operate with the tops of the pins on the opposed co-acting refining element.

BRIEF DESCRIPTION OF THE DRAWINGS

The present invention is described in greater detail in the following detailed description with reference to the accompanying drawings wherein.

DETAILED DESCRIPTION

Figure 1:
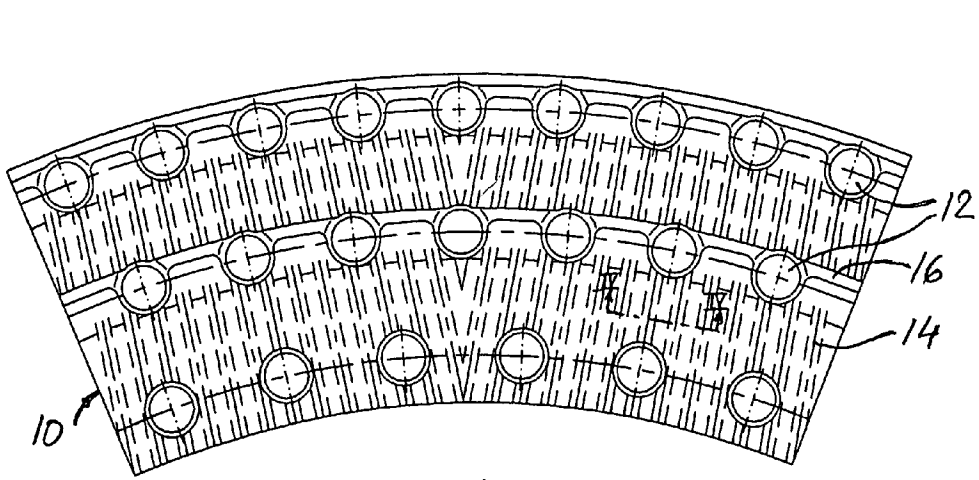
FIG. 1 is a top, elevational view of a first co-acting refining element according to the present invention.
Figure 2:
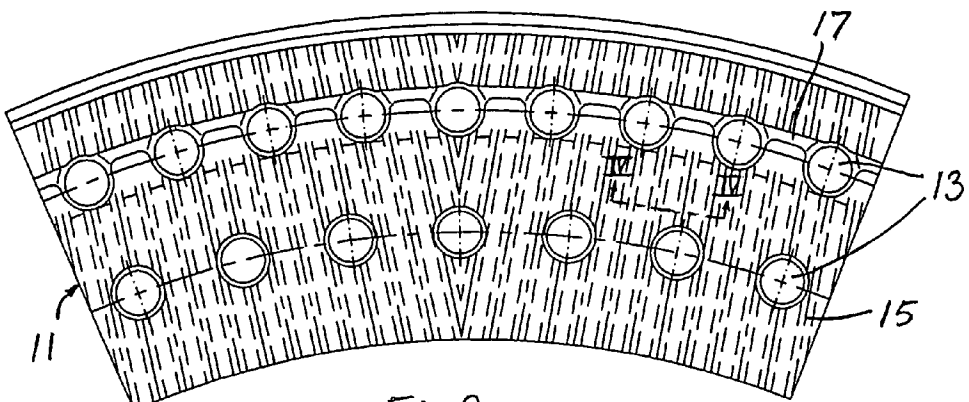
FIG. 2 is a top, elevational view of the second of a pair of co-acting refining elements according to the present invention.
Figure 3:
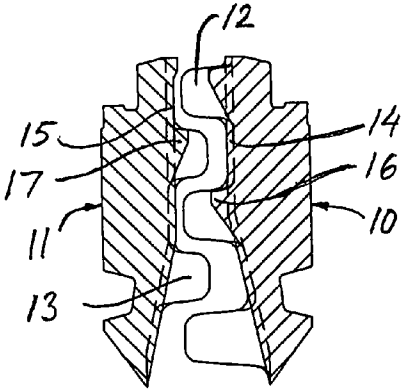
FIG. 3 is a side, elevational, partial cross-sectional view of the refining elements seen from the side in processing position.
Figure 4:
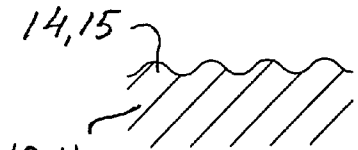
FIG. 4 is a side, elevational, partial view of an embodiment of the wave-shaped bottom surface of the refining elements as shown by cross-section according to IV-IV in FIGS. 1 and 2.

The co-acting refining elements, 10 and 11, are intended to be placed on each of two opposed refining discs in a refiner, where the refining discs are rotary relative to one another. The refining elements shown are provided with projecting processing means in the form of pins, 12 and 13, with substantially circular cross-sections, which are placed in several rows in the circumferential direction. The rows of pins are arranged radially spaced from each other on the bottom surface of the refining elements.

The pins, 12 and 13, should be arranged in at least two radially separated rows, and the pins should be substantially cylindrical with a diameter of from about 10 to 30 mm, preferably from about 15 to 25 mm, and having rounded tops. The tops of the pins can be uniformly rounded or have a plane surface with rounded edges. The length should be from about 10 to 30 mm, preferably from about 15 to 25 mm.

Alternatively, slightly conical pins can be used. The bottom surface of the refining elements between the pins is provided with bars, 14 and 15, with rounded edges forming a wave-shaped surface. The plurality of the bars are interdispersed in an area defined by a radial line between the plurality of the pins adjacent in the radial direction. In processing position the pins extend transversely across the refining gap almost all the way to the surface of the opposed refining element, so that a narrow gap is formed between pins and bars.

The rounded bars suitably extend substantially radially across the entire portion of the refining elements which is provided with pins. Alternatively, the bars can be arranged at an angle in relation to the radius of the refining element. In that manner, a feeding or braking effect can be obtained, depending on in which direction the bars are angled in relation to the direction of movement of the refining elements during the processing operation. The tops of the bars should be rounded in such a way, that a uniform wave-shaped pattern is formed on the bottom surface of the refining elements. This ensures a uniform and lenient processing. The height of the rounded bars should be from about 1 to 5 mm, suitably from about 2 to 4 mm, the roundness having a radius of from about 1 to 5 mm, suitably from about 2 to 4 mm.

The refining elements, 10 and 11, can also be provided with flow restrictions in the form of ledges, 16 and 17, extending substantially in the circumferential direction. The ledges shall be lower than the pins, 12 and 13, but higher than the bars, 14 and 15, suitably from about 4 to 12 mm, preferably from about 6 to 10 mm. The ledges can be placed in connection to the pins along circle arches. Alternatively, they can be given a direction which slightly deviates from an arch, i.e. the radius increases or decreases along a ledge. The ledges can be continuous or discontinuous. Discontinuous ledges can extend between two pins.

At the outward passage of the material through the refining gap between the co-acting refining elements, 10 and 11, the material will be processed partly at the passage between the tops of the pins, 12 and 13, on one refining element and the rounded bars, 14 and 15, on the opposed refining element. By this combined processing an improved but simultaneously lenient defibering effect is obtained. The fibers of the material are separated and processed effectively without unfavourable fiber cutting, resulting in a high and uniform pulp quality.

The ledges, 16 and 17, have the object to affect the stay-time of the material in the refining gap. The height and direction of the ledges are thus of decisive importance. This favourable effect on the material implies that even a non-uniform supply of material is counter-balanced in the refining gap, which has a stabilizing effect on the entire processing process.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A refiner system including a first refiner element and a second refiner element, said first and second refiner elements adapted for mounting in a refiner for relative rotation in a face-to-face relationship with a predetermined gap therebetween for processing material within said predetermined gap, each of said first and second refiner elements including a refining surface, a plurality of pins extending upwardly from said refining surfaces whereby said plurality of pins on said first refining surface are disposed in intermediate spaces between said plurality of pins on said second refining surface, each of said plurality of pins on said first and second refiner surfaces including a plurality of said pins adjacent in a radial direction, each of said first and second refining surfaces further including a plurality of bars including rounded edges forming a wave-shaped surface thereon, said plurality of bars being interdispersed in an area defined by a radial line between said plurality of said pins adjacent in said radial direction.

2. The refiner system of claim 1 wherein said plurality of pins on said first and second refining surfaces include rounded upper surfaces.

3. The refiner system of claim 1 wherein said plurality of bars on said first and second refining surfaces extend substantially radially across said refining surfaces.

4. The refiner system of claim 1 wherein said first and second refining surfaces include a plurality of ledges formed as circular arches on said refining surfaces relative to said plurality of pins.

5. The refiner system of claim 4, wherein said plurality of ledges include upper surfaces sloping upwardly from said refining surface, said upper surfaces sloping into an area between said plurality of said pins adjacent in said radial direction.

6. The refiner system of claim 5, wherein said upper surfaces of the ledges slope beyond a position formed by a radial line between centers of two adjacent pins.

* * * * *